US006484879B2

(12) United States Patent
Desmarais et al.

(10) Patent No.: US 6,484,879 B2
(45) **Date of Patent: *Nov. 26, 2002**

(54) WATER SOLUBLE PACKAGING SYSTEM AND METHOD

(75) Inventors: Armand J. Desmarais, Valparaiso, IN (US); Henry E. Knoop, Valparaiso, IN (US); Lawrence C. Dull, Greensboro, NC (US); Jean A. Raymond, Lattes (FR)

(73) Assignees: Syngenta Crop Protection, Inc., Greensboro, NC (US); MonoSol, LLC, Portage, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/833,567

(22) Filed: Apr. 7, 1997

(65) Prior Publication Data

US 2001/0054567 A1 Dec. 27, 2001

Related U.S. Application Data

(60) Provisional application No. 60/057,588, filed on Apr. 8, 1996.

(51) Int. Cl.[7] ..... B65D 85/84; B65D 30/08

(52) U.S. Cl. ..... 206/524.7; 383/1; 383/113

(58) Field of Search ..... 383/1, 113; 206/524.7, 206/484

(56) References Cited

U.S. PATENT DOCUMENTS

| | | | | |
|---|---|---|---|---|
| 3,661,695 A | * | 5/1972 | Berliner | 383/1 X |
| 3,790,067 A | | 2/1974 | Scheier | |
| 3,892,905 A | * | 7/1975 | Albert | 206/524.7 X |
| 4,416,791 A | | 11/1983 | Haq | |
| 4,626,372 A | * | 12/1986 | Kaufmann et al. | 206/524.7 X |
| 4,716,041 A | | 12/1987 | Kjornaes et al. | |
| 4,765,916 A | | 8/1988 | Ogar, Jr. et al. | |
| 4,868,024 A | | 9/1989 | Cross et al. | |
| 4,946,720 A | | 8/1990 | Oishi et al. | |
| 5,080,226 A | * | 1/1992 | Hodakowski et al. | 206/524.7 X |
| 5,108,807 A | | 4/1992 | Tucker | |
| 5,139,152 A | | 8/1992 | Hodakowski et al. | |
| 5,158,810 A | | 10/1992 | Oishi et al. | |
| 5,222,595 A | | 6/1993 | Gouge et al. | |
| 5,224,601 A | | 7/1993 | Gouge et al. | |
| 5,248,038 A | * | 9/1993 | Hodakowski et al. | 206/524.7 |
| 5,253,759 A | | 10/1993 | Gouge et al. | |
| 5,279,421 A | | 1/1994 | Gouge et al. | |
| 5,280,835 A | * | 1/1994 | Edwards et al. | 206/484 |
| 5,283,090 A | | 2/1994 | Umemura | |
| 5,323,906 A | | 6/1994 | Gouge et al. | |
| 5,330,047 A | | 7/1994 | Gouge et al. | |
| 5,346,068 A | | 9/1994 | Gouge et al. | |
| 5,351,831 A | | 10/1994 | Gouge et al. | |
| 5,558,228 A | | 9/1996 | Jackisch et al. | |

FOREIGN PATENT DOCUMENTS

| | | | | |
|---|---|---|---|---|
| GB | 922317 | * | 3/1963 | 206/524.7 |
| WO | 91/17202 | | 11/1991 | |

* cited by examiner

*Primary Examiner*—Bryon P. Gehman
(74) *Attorney, Agent, or Firm*—William A. Teoli, Jr.; Thomas Hamilton

(57) ABSTRACT

The present invention relates to a bag packaging system composed of a bag sealable to contain a liquid, in which the bag is composed of a continuous outer water soluble film and an inner continuous protective film layer that allows storage therein of a liquid that would chemically or physically react with the water soluble film but is prevented from doing so by the presence of the continuous protective film layer on the inner portion of the bag.

33 Claims, 3 Drawing Sheets

WATER SOLUBLE PACKAGING SYSTEM AND METHOD

CROSS-REFERENCE TO RELATED APPLICATIONS

This application claims the benefit under 35 USC§ 119(e) of copending U.S. provisional Application Ser. No. 60/057,588, filed Apr. 8, 1996, which is fully incorporated by reference herein.

FIELD OF THE INVENTION

The present invention relates to a multi-layer water soluble or dispersible packaging film and its use in packages for containing potentially hazardous organic chemicals. More particularly, the present invention relates to a water soluble or dispersible packaging system having a continuous film barrier on the interior portion of the package for containing agricultural chemicals having a tendency to adversely affect or otherwise be deleterious to the outer film portion of the water soluble or dispersible packaging system.

BACKGROUND OF THE INVENTION

Pesticides, such as herbicides, insecticides, fungicides and other types of agricultural chemicals (referred to herein as "agrichemicals") are often potentially harmful materials and are commonly made in concentrated form which can be as a solid, a liquid, a dispersion or a gel, for example. Such materials typically need to be diluted with water prior to use. Numerous other types of hazardous and toxic materials are also commonly sold and used on a commercial basis. Containers are needed for the aforementioned types of hazardous and toxic materials in order to conveniently distribute, sell and utilize such materials.

Typically, such containers are metal or blow molded plastic. However, there are hazards and difficulties in handling, storing and using such types of containers and materials. In addition, particularly with highly concentrated materials, hazards exist when such concentrates are diluted for use, such as when pouring the concentrate into a tank or other container. For example, the concentrated material can splash or spill in unintended locations, causing unintended human, animal or other contact with the concentrate.

In addition, disposal of the metal or plastic containers can be a problem since some residual concentrated material will remain in the original container. Thus, disposal of such containers can become an environmental problem.

It is known to package certain materials, including certain liquids in water soluble bags consisting of a layer of cold water soluble polyvinyl alcohol. Such packaging is disclosed in U.S. Pat. No. 5,351,831, for example. However, such packaging and similar types of packaging are not suitable for containing agrichemicals that deleteriously affect cold water soluble polyvinyl alcohol film, such as by chemical or physical reaction with it, including dissolving the cold water soluble film. Consequently, a need exists for a suitable cold water soluble or dispersible container that can contain agrichemicals and other materials that chemically, physically or otherwise deleteriously react with the water soluble film that forms the water soluble bag. In addition, a need exists for a cold water soluble or dispersible bag for storing such agrichemicals and other materials that is reliable and easy to produce.

SUMMARY OF THE INVENTION

In accordance with the present invention, a multi-layer cold water soluble or dispersible packaging film is provided which comprises: (i) a first "outer" continuous cold water soluble or dispersible film layer of sufficient thickness and strength for use as a package to contain chemicals, and (ii) a second "inner" continuous water soluble or dispersible film layer which is both chemically differentiated from and thinner than said first layer. The multi-layer film of the present invention is suitable for use as a package to contain potentially hazardous materials, particularly chemicals that dissolve water soluble film or chemically, physically or otherwise deleteriously react with or adversely affect water soluble film. The water soluble or dispersible packaging system prepared from the multi-layer film generally is conveniently in the form of a bag, a pouch or a sachet. Other conventional container configurations also are contemplated by the packaging system of the invention.

As used herein, the term "chemical" includes all types of potentially hazardous chemical materials, particularly organic chemicals including, but not limited to, agrichemicals. The term "agrichemicals" includes, for example, agronomically useful chemicals from the following classes: plant nutrients, plant growth regulators, plant protection agents such as pesticides (e.g., herbicides, insecticides, nematocides, acaricides, molluscicides, fungicides, etc.), activity promoters, penetrating agents, synergists, antidotes and safeners, activators, compatibility agents, and adjuvants. The term "agrichemicals" also includes agrichemical compositions (mixtures of one or more agrichemicals with any conventional agronomically acceptable carrier or diluent). The multi-layer film of the present invention can be used to make water soluble or dispersible packages that are suitable for containing chemicals such as agrichemicals or agrichemical compositions in the form of liquids, solids, or gels. Suitable liquids are, for example, in the form of dispersions, solutions, suspensions, emulsions and colloids. Solids are in the form of powders, granules and prills, for example. The term "cold water" means liquid water at a temperature of less than 50° C., preferably lower than 35° C., for example, between 5° C. and 35° C. "Cold water soluble" means completely soluble in cold water. "Dispersible" means disintegration or dissipation as fine particles. Preferably, the dispersed particles are small enough to pass through the orifice of a conventional agrichemical spray apparatus or are filterable without plugging the spray orifice or filter of a conventional agrichemical sprayer. For example, particles having a mean particle size of from about 0.1 to about 250 microns as measured by the CIPAC MT176 test for dissolution capacity of water soluble sachets are considered to be dispersible for the purpose of the present invention. The term "substantially adversely affect" in the context of contact with cold water soluble film by an agrichemical material or other chemical material means that the material is not suitable for containment in a package made of the film because of any deleterious effect caused by contact of the material and the film, whether a chemical or physical reaction including, for example, dissolving the film by the material and unwanted physical leaching of film components into the material. In addition, the material stored in the package can affect the film material by, for example, physically altering the properties of the film such as extraction of plasticizer which makes the film brittle, making the film insoluble or otherwise unsuitable for use in packaging agrichemicals.

The multi-layer cold water soluble or dispersible film in accordance with one aspect of the invention includes a first outer continuous layer of cold water soluble film of sufficient thickness and strength to provide sufficient structural strength for use as a bag to contain liquid. Advantageously, the first or outer film layer may itself contain multiple layers of the same film type (such as co-extruded or tri-extruded cold water soluble films) as is known in the art. The multi-layer cold water soluble or dispersible film of the invention includes a second inner layer, chemically differentiated from the outer layer, which is an inner continuous or substantially continuous barrier layer of a material that can be cold water or hot water soluble or insoluble film securely adhered to and in intimate contact with the outer layer. The inner barrier film layer serves the purpose of preventing, impeding or otherwise reducing the interaction between the contents of a package made from the multi-layer film and the first outer film layer. In one embodiment, the inner barrier film layer is substantially continuous with the outer film layer such that the multi-layer film has edge or border areas which do not contain a barrier film layer to facilitate heat sealing or other sealing means.

When water insoluble or hot but not cold water soluble material is the barrier, the inner continuous layer of water insoluble film is frangible or otherwise lacks sufficient structural integrity to contain the chemical in a bag. Typically, the thickness of the first outer cold water soluble layer is much thicker than the second inner barrier layer. In one embodiment, the thickness ratio of the first outer layer to the second inner layer is from about 500:1 to about 2:1, preferably from about 400:1 to about 3:1. When a bag formed of the inventive multi-layer water soluble film is sealed with the chemical contained therein, once the water soluble film layer is dissolved, such as when the package is placed in water, the inner continuous barrier layer releases the chemical in the bag by dissolving or dispersing. This occurs because the outer water soluble structural layer has dissolved and the barrier or inner water insoluble layer is frangible or otherwise lacks sufficient structural integrity to remain intact and contain the agrichemical particularly when agitated in the spray tank of a conventional agrichemical sprayer. Preferably, as noted above, the barrier layer disperses or dissolves sufficiently to allow flushing into sanitation systems, passage through filters and spray nozzles.

Suitable materials for the first cold water soluble or dispersible film layer can be selected from a wide variety of materials including, for example, polyvinyl alcohol, polyoxyethylene or a combination thereof.

The second barrier film layer can be cold water soluble, hot water soluble or dispersible. In order to properly function as a barrier, the barrier material should be at least not as susceptible to interaction with the agrichemical or other material to be packaged as is the outer film layer.

In accordance with another aspect of the present invention, a water soluble or dispersible package (conveniently a bag) is provided that is suitable for containing agrichemicals and other chemicals which substantially adversely affect water soluble film. The bag is also useful for containing other types of chemicals. The water soluble or dispersible bag in accordance with the invention is formed from the aforesaid inventive multi-layer water soluble film. For example, the bag is formed by sealing two sheets of the multi-layer film together at the edge regions by means of an adhesive or heat seal.

In accordance with another aspect of the present invention, a water soluble or dispersible bag is provided for containing agrichemicals, the bag being particularly suitable for containing agrichemicals that substantially adversely affect cold water soluble film. The bag is composed of an outer layer of cold water soluble film and a continuous inner barrier film layer wherein the agrichemical composition does not substantially deleteriously affect the inner barrier film layer and the inner barrier film layer is capable of preventing or impeding the agrichemical composition when stored therein from contacting the outer cold water soluble film layer and wherein when the bag is placed in water with the agrichemical store therein, the water soluble film layer dissolves and the inner barrier layer dissolves or disperses into particles small enough to allow the agrichemical to disperse or dissolve into the water without clogging the spray system.

In accordance with still another aspect of the present invention, a water soluble bag packaging system is provided for containing and transporting chemicals, particularly agrichemicals, which substantially adversely affect cold water soluble film, including by chemical or physical reaction or otherwise. The packaging system includes a bag formed of the inventive multi-layer water soluble film having the inner continuous water insoluble film layer or barrier layer on the interior portion of the bag. The inner barrier layer prevents or impedes the agrichemical composition from contacting the water soluble film layer and when the packaging system is placed in water or other medium that dissolves the water-soluble film layer, the inner barrier layer, lacking sufficient structural integrity and strength to contain the agrichemical contained therein, releases the agrichemical. Consequently, dispersion into the water or other desire medium is provided.

In accordance with still another aspect of the present invention, a method of storing a liquid that chemically, physically or otherwise deleteriously reacts with cold water soluble film in a water soluble film is provided. The method includes forming a bag from a multi-layer water soluble film that is comprised of an outer continuous layer of water soluble film of sufficient thickness and strength to provide adequate structural strength and integrity for use as a bag to contain liquid and wherein the multi-layer water soluble film includes an inner continuous layer of a water insoluble film or water soluble film over the outer layer that is not dissolved by or otherwise is not substantially adversely affected by the chemical stored in the bag. The inner continuous layer lacks sufficient structural integrity to contain the liquid in the bag once the water soluble film layer is dissolved. The method further includes placing the liquid in the bag and thereafter sealing the bag with the liquid contained therein.

DETAILED DESCRIPTION OF THE INVENTION

Figure 1:
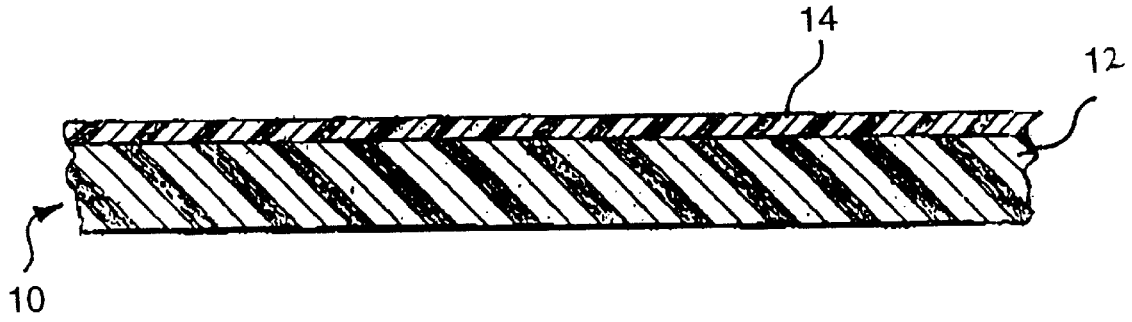
FIG. 1 is a cross-sectional view of a water soluble film in accordance with the present invention.

Referring the drawings generally and in particular to FIG. 1, there is shown a multi-layer water soluble film 10 composed of a relatively thick first layer 12 composed of a cold water soluble film and a relatively thin second or barrier film layer 14 that is a barrier layer for the chemical to be contained in a bag made from film 10.

Generally, layer 12 of the multi-layer water soluble or dispersible film 10 is relatively thick, sufficiently thick to provide the necessary structural strength for use as a bag to contain the desired chemical. Depending on the type of cold water soluble film, typical thicknesses will be in the range from about 10 to about 500 microns or greater, for example and more typically about 20 to about 75 microns. The actual thickness will be dependent on the type of application, including the type of water soluble material, the size of the bag and the density and amount of the material to be stored therein.

The thickness of second film layer 14 of barrier material is generally relatively thin, typically in the range of from about 0.25 to about 25 microns or more and preferably about 0.05 to about 15 microns. Generally, the purpose of second layer 14 is to provide a barrier so that chemicals contained in a bag formed from film 10 contacts barrier layer 14 and does not contact first layer 12 of cold water soluble film. In this manner, film barrier 14 is impervious or resistant to the chemical contained in the bag. Consequently, it is important that second layer 14 be continuous or at least substantially continuous for storing and containing certain chemicals that would be particularly aggressive in attacking the cold water soluble film of first layer 12. For aggressive agrichemicals, a continuous second layer 14 becomes more important or even necessary to properly function as a barrier between the agrichemical and first layer 12 composed of the cold water soluble film or dispersible.

Figure 2:
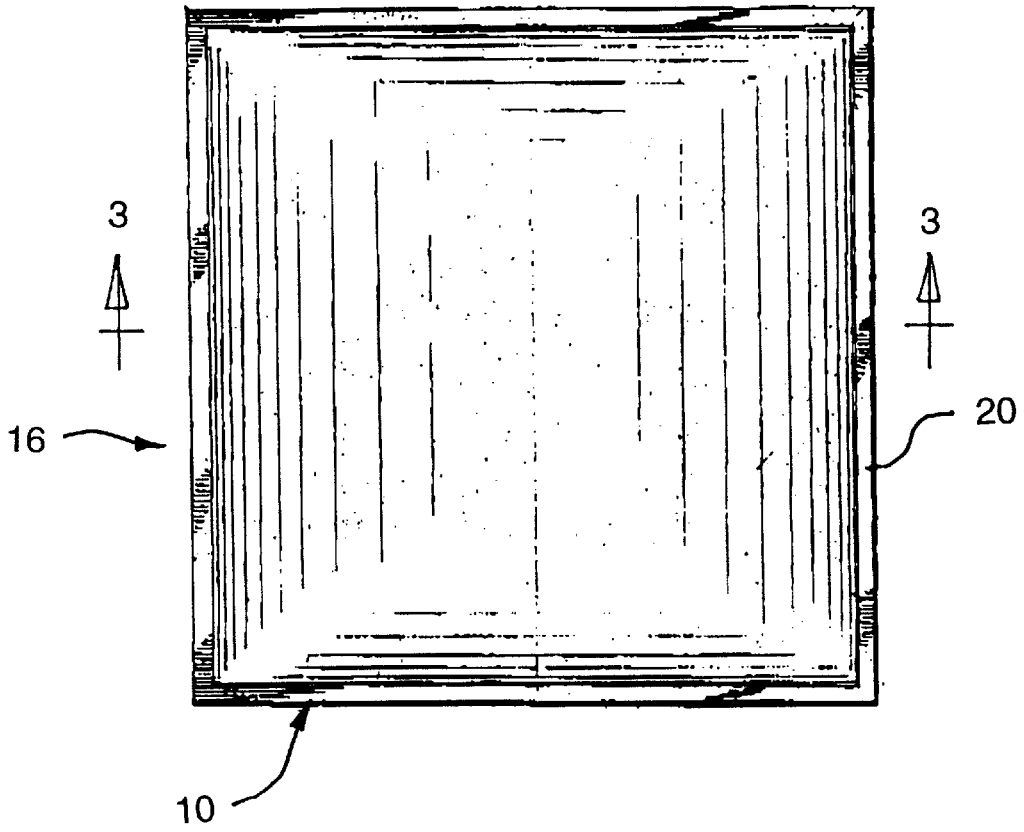
FIG. 2 is a plan view of a bag containing an agrichemical and constructed from the film of FIG. 1.
Figure 3:
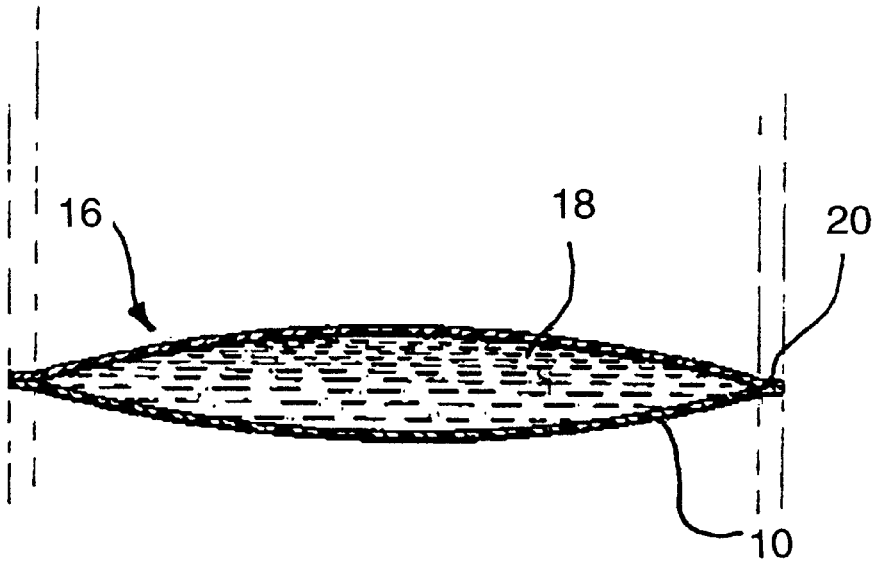
FIG. 3 is a cross-sectional view along lines 3—3 of FIG. 2.

FIGS. 2 and 3 illustrate a bag 16 in accordance with the present invention that has been sealed and contains an agrichemical 18 therein as shown in FIG. 3. Bag 16 is composed of a sheet of multi-layer water soluble film 10 that has been folded over and has a hot bar heat seal 20 along the four peripheral sides of bag 16, as best shown in FIG. 2.

As is well known to those skilled in the art, the equipment for and methods of making bag 16 are well known to those skilled in the art. Consequently, a detailed disclosure of such is not provided. Any bag design or construction can be utilized in accordance with the invention as long as the bag can be formed with multi-layer water soluble film 10 in a desired fashion, filled with an agrichemical and sealed closed with the material therein Any suitable method of sealing the bag and type of seal can be utilized including hot bar, impulse or other heat seal, solution seal, adhesive seal and ultrasonic seal. Generally, a heat or a solution seal is preferred.

Many types of water soluble films are suitable for use as the first layer 12 of multi-layer film 10 in accordance with the invention. For example, suitable water soluble films include polyvinyl alcohol, polyoxyethylene (such as 15 polyoxyethylene), cellulose derivatives such as methylcellulose (MC), methylhydroxyethyl cellulose (MHEC), methylhydroxpropylcellulose (MHPC), hydroxypropyl cellulose (HIPC), cellulose monoacetate, hydrophobically modified cellulose derivatives, sodium polyacrylate, polylactic acid, lactic acid ethers or esters of polyvinyl alcohol, lactic acid ethers or esters of cellulose derivatives, lactic acid grafts on polyvinyl alcohol, carrageenan, pectin, combinations of the foregoing and combinations of the forgoing and starch. For example, suitable hydrophobically modified cellulose derivatives include C-16 modified HEC, MHPC and HIPC. All of the foregoing materials can be cold water soluble.

Starch may be added and used in combination with the foregoing water soluble materials to make first layer 12. For example, suitable starches include unmodified or modified corn, potato, rice and wheat starches.

Suitable materials for the generally relatively thin barrier layer 14 generally can be selected from three categories: (1) cold water soluble, but with at least less reactivity or susceptibility to interaction with the agrichemical (or other material to be contained in the bag) than the outer layer; (2) hot water soluble; and (3) dispersible barriers. In addition, the barrier layer must have good adhesion properties to, and otherwise be compatible with, relatively thick first layer of water soluble film 12, and also be chemically and physically compatible with the material to be stored in the resulting container made with film 10.

In one embodiment, the barrier layer is a polymer present as a thin continuous layer that does not dissolve in water at temperatures above 50° C. Suitable polymers can be selected from cellulose derivatives in which the degree of substitution is sufficient to prevent solubility above 50° C. such as, for example, cellulose acetate lactate, cellulose lactate, methylhydroxybutyl cellulose and hydrophobically modified cellulose derivatives.

In accordance with another embodiment, the inner layer or barrier 14 is a continuous, thin polymer layer that does not dissolve in water at temperatures below about 50° C. Suitable materials for this embodiment include polyvinyl alcohol that does not dissolve in water at temperatures below 50° C., including between 97% and 99.99% hydrolyzed polyvinyl alcohol. Generally, such hot water soluble films will be utilized as a thin layer, usually from about 0.25 to about 15 microns thick, so that the barrier disintegrates once the outer cold water soluble film dissolves.

In still another embodiment of the present invention, barrier layer 14 can be composed of a polymer film material that dissolves in water but is less or substantially less reactive than the material of first or outer layer 12 of film 10 to the agricultural composition or other material to be contained within a bag constructed of such material. Generally, such barrier layers are not suitable for aqueous solutions containing free water. Generally, such barrier layers are suitable for packaging organic solvent-based materials and solids.

Generally, cold water soluble materials can be utilized for the inner barrier layer when the cold water soluble barrier material is not as susceptible to interaction with the agrichemical or material to be packaged as the material of the outer layer. For example, when the outer layer is cold water soluble polyvinyl alcohol, suitable cold water soluble materials, depending on the material to be packaged, include cellulose derivatives having a degree of substitution (DS) or moles of substitution (MS) that provide solubility in water in the range of 5–60° C. or greater, such as methyl cellulose, methylhydroxyethyl cellulose, methylhydroxpropyl cellulose, methylethyl cellulose, methylhydroxybutyl cellulose, hydroxypropyl cellulose, carboxymethyl cellulose, hydrophobically modified cellulose derivatives, cellulose monoacetate, cellulose acetate lactate, cellulose lactate, karaya gum, guar gum, carrageenan, pectin, gum, tragacanth, sodium alginate, gum arabic, xanthan gum, sodium acrylate and ammonium acrylate.

In another embodiment, inner layer or barrier 14 can be selected so as to disperse or disintegrate in water, provided that it exhibits the proper resistance and other properties with respect to the agrichemical or other material to be contained in a bag constructed of such a film. Suitable materials for the inner barrier layer 14 for this embodiment include acrylic acid polymers, acrylic ester polymers, acrylic acid copolymers, acrylic ester copolymers, copolymers of acrylic acids and esters, crosslinked polyvinyl alcohols, crosslinked cellulose derivatives, ethyl cellulose, nitrocellulose, cellulose butyrate, cellulose acetate butyrate, ethylene vinyl alcohol, ethylene vinyl acetate, polyvinylidene chloride and alkali soluble waxes and polyurethanes.

Other materials may be known to those skilled in the art for barrier layer 14. Any suitable method of making multi-layer water soluble film 10 can be utilized. For example, the inner barrier layer can be laminated to the outer water soluble film layer in a manner well known to those skilled in the art. In addition, the inner layer can be co-extruded by a thermal process to the outer water soluble film layer, such as by blown film or slot die extrusion. Further, the inner barrier layer can be coated onto the outer water soluble film layer. Other suitable techniques of fabricating the multi-layer water soluble film 10 in accordance with the invention known in the art could also be utilized.

Some agrichemicals are generally unsuitable for storage in cold water soluble polyvinyl alcohol bags, namely CIBA HST.

EXAMPLES

The following are examples of multi-layer film in accordance with the invention matched with agrichemicals and other materials to be contained by containers made from such film.

Example 1

Open-topped, heat sealed water soluble or disintegratable bags are produced from a two-layer film composed of a 38 micron outer cold water soluble polyvinyl alcohol (PVOH) (88% hydrolysis, 25 cps) layer and a 1.0 micron cold water dispersible polyvinylidene chloride barrier layer and are manually filled with from 10 grams to 2300 grams of a pesticide, which is not compatible with the outer cold water soluble PVOH layer, in the form of a wettable powder or water dispersible granule. In the absence of the barrier layer, this incompatibility would result in loss of desirable physical properties (puncture resistance, tear resistance, drop impact resistance, water solubility etc.) of the water soluble layer upon exposure to the pesticide. The pesticide composition of the wettable powder on a % by weight basis is 50% active ingredient, 3% wetting agent, 5% dispersant, and 42% diluent, where the wetting agent is typically an anionic surfactant such as alkyl sulfonate (e.g. sodium dodecylbenzenesulfonate) or an alkyl naphthalene sulfonate (e.g. sodium isopropyl naphthalene sulfonate); the dispersant is typically a sodium lignosulfonate; and the diluent is an inert inorganic material, such as a kaolinite clay, or an alkyl naphthalene sulfonate (e.g. sodium isopropyl naphthalene sulfonate); the dispersant is typically a sodium lignosulfonate; and the diluent is an inert inorganic material, such as a kaolinite clay, or an inert organic material such as starch.

The pesticide composition for a water dispersible granular composition on a % by weight basis is 35% active ingredient, 3% wetting agent, 7% dispersant, 1% bonder, and 54% diluent, where the wetting agent is typically an anionic surfactant such as alkyl aryl sulfonate (e.g. sodium dodecylbenzenesulfonate) or an alkyl naphthalene sulfonate); the dispersant is typically a sodium lignosulfonate; the binder is a water soluble polymer such as polyvinylpyrrolidone; and the diluent is an inert inorganic material such as a kaolinite clay or an inert organic material such as starch.

After the bags are filled, they are manually or automatically heat sealed at the top by the two sealing jaws of a thermoplastic bag hot bar heat sealer that heats the polymer under pressure until a heat seal is formed. The heat sealed bags are placed in a outer package which is suitable for storing the water soluble bags for acceptably long periods of time before being removed from the outer package and introduced into the main tank (typically 50 to 600 gallons in size) of a spraying system which has water residing in it. Tank agitation is started and in a reasonably short period of time the water soluble bags dissolve with disintegration of the barrier layer and the pesticide dissolves or disperses in the water, creating a spray solution which is then typically sprayed on a growing crop.

Example 2

Two layer water soluble bags are produced on a form-fill-seal machine and filled with a pesticide in the form of a flowable or emulsifiable concentrate or gel. These water soluble bags are produced from a two-layer film composed of a 50.8 micron outer cold water soluble polyvinyl alcohol layer having an 88% degree of hydrolysis and a viscosity of 23 cps. and a 0.7 micron layer of ethylene vinyl acetate. The flowable suspension concentrate composition on a % by weight basis is 40% pesticide active ingredient, 2% wetting agent, 3% dispersing agent, 5% antifreeze, 0.1% anti-foam, 0.2% thickening agent, and 49.7% water, where the wetting agent is typically a nonionic surfactant (e.g. polyalkoxylated nonylphenol); the dispersing agent is typically a sodium lignosulfonate; the antifreeze is a water soluble polyhydroxy material such as ethylene glycol or glycerin; the anti-foam is a poly(dimethylsiloxane); and the thickening agent is a polymeric organic material such as carboxymethycellulose.

The emulsifiable concentrate composition on a % by weight basis is 25% pesticide active ingredient, 8% emulsifier system, and 67% solvent, where the emulsifier system is a mixture of an anionic surfactant (e.g. calcium dodecylbenzenesulfonate) 3–4% and a nonionic surfactant (e.g. polyalkoxylated castor oil) 4–5%; and the solvent is typically a petroleum based aromatic solvent (which depending on the solubility characteristics of the active ingredient may be partially or wholly replaced by a more polar solvent such as an alcohol or a ketone).

The two-layer water soluble film in roll form is mounted to a form-fill-seal machine. The thickness of the outer cold water soluble polyvinyl alcohol layer of the film is typically 20 to 76 microns and the inner barrier of EVA is from 0.25 to 1.25 microns. The two-layer water soluble or dispersible film is formed into an open ended bag by conveying the film over a forming shoulder and heat sealing simultaneously with the bottom and side of the bag using hot bar or impulse sealing methods. The flowable or emulsifiable concentrate or gel product is then introduced into the open ended bag (typically in the range of 5 ml to 2000 ml). Each filled bag is heat sealed at the top following dispensing of the pesticide into the bag. Each bag is then loaded (either manually or automatically) into an outer package that is distributed and used as discussed in Example 1.

Examples 3–13

Following procedures similar to those outlined in Examples 1–2, two layer bags are made from the following components:

| Example | Cold Water Soluble Film | Thickness | Barrier Layer | Thickness |
|---|---|---|---|---|
| 3 | Methylhydroxpropyl cellulose | 75 micron | PVDC | 1.0 micron |
| 4 | Methylhydroxpropyl cellulose | 75 micron | EVOH | 1.4 micron |

-continued

| Example | Cold Water Soluble Film | Thickness | Barrier Layer | Thickness |
|---|---|---|---|---|
| 5 | Methylhydroxpropyl cellulose | 75 micron | alkali soluble acrylic | 2.0 micron |
| 6 | Methylhydroxpropyl cellulose | 75 micron | nitrocellulose | 1.0 micron |
| 7 | Polyethylene Oxide | 50 micron | PVOH, 99% Hydrolysis | 5 micron |
| 8 | Polyethylene Oxide | 50 micron | Acrylic acid/ ester copolym | 1.5 micron |
| 9 | Carrageenan | 75 micron | Crosslinked MHPC | 5.0 micron |
| 10 | Cellulose mono-acetate | 38 micron | Cellulose butyrate | 2.0 micron |
| 11 | Lactic acid grafts of PVOH | 38 micron | EVOH | 1.0 micron |
| 12 | PVOH, 88% Hydrolysis | 38 micron | MHPC | 25 micron |
| 13 | Pectin/Starch | 50 micron | polyurethane | 1.0 micron |

An example agrichemical formulation of wettable powder is by weight 50% active ingredient, 3% wetting agent, 5% dispersant, and 42% diluent, where the wetting agent is typically an anionic surfactant such as alkyl sulfonate (e.g. sodium dodecylbenzenesulfonate) or an alkyl naphthalene sulfonate (e.g. sodium ispropyl naphthalene sulfonate); the dispersant is typically a sodium lignosulfonate; and the diluent is an inert inorganic material, such as a kaolinite clay, or an inert organic material such as starch.

An example agrichemical formulation of water dispersible granule is by weight 35% active ingredient, 3% wetting agent 7% dispersant, 1% bonder, and 54% diluent, where the wetting agent is typically an anionic surfactant such as alkyl aryl sulfonate (e.g. sodium dodecyibenzenesulfonate) or an alkyl naphthalene sulfonate (e.g. sodium isopropyl naphthalene sulfonate); the dispersant is typically a sodium lignosulfonate; the binder is a water soluble polymer such as polyvinylpyrrolidone; and the diluent is an inert inorganic material such as a kaolinite clay or an inert organic material such as starch.

An example agrichemical formulation of flowable suspension concentrate is by weight 40% active ingredient, 2% wetting agent 3% dispersing agent, 5% antifreeze, 0.1% anti-foam, 0.2% thickening agent, and 49.7% water, where the wetting agent is typically an nonionic surfactant (e.g. polyalkoxylated nonylphenol); the dispersing agent is typically a sodium lignosulfonate; the antifreeze is a water soluble polyhydroxy material such as ethylene glycol or glycerin; the anti-foam is a poly(dimethylsiloxane); and the thickening agent is a polymeric organic material such as carboxymethyl cellulose.

An example agrichemical formulation of emulsifiable concentrate is by weight 25% active ingredient, 8% emulsifier system, and 67% solvent, where the emulsifier system is a mixture of an anionic surfactant (e.g. calcium dodecylbenzenesulfonate) 3–4% and a nonionic surfactant (e.g. polyalkoxylated castor oil) 4–5%; and the solvent is typically a petroleum based aromatic solvent (which depending on the solubility characteristics of the active ingredient may be partially or wholly replaced by a more polar solvent such as an alcohol or a ketone).

What is claimed is:

1. A water soluble bag packaging system for transporting an agrichemical that chemically or physically reacts with water soluble films, said packaging system comprising;

a bag containing an agrichemical composition having an agrichemical therein;

said bag comprising an outer cold water-soluble film layer and an inner barrier layer; said inner layer being a continuous film and preventing the agrichemical composition from contacting the outer cold water-soluble film layer, said outer cold water-soluble film layer providing structure to said bag packaging system, the inner barrier layer being a polymer layer which does not dissolve in water at temperatures above 50° C. and is selected from the group consisting of cellulose derivatives in which the degree of substitution is sufficient to prevent solubility above 50° C. selected from the group consisting of cellulose acetate lactate, cellulose lactate, methylhydroxybutyl cellulose, hydrophobically modified cellulose derivatives, and combinations thereof; whereby when the packaging system is placed in water and said outer cold water-soluble film layer dissolves, then said inner barrier layer dissolves or disperse into particles of up to about 250 microns and are small enough to allow the agrichemical to disperse into the water.

2. The packaging system of claim 1, wherein the outer cold water-soluble film layer is a film selected from the group consisting of polyvinyl alcohol, 15 polyoxyethylene or a combination of the above.

3. The packaging system of claim 2, wherein the inner barrier layer is a polymer layer which dissolves in water but is less reactive than polyvinyl alcohol or 15 polyoxyethylene to the agrichemical composition being packaged.

4. The packaging system of claim 3, wherein the inner barrier layer is selected from the group consisting of cellulose derivatives which have a degree of substitution (DS) or moles of substitution (MS) that provides solubility at a temperature of at least 5° C.

5. The packaging system of claim 1, wherein the outer cold water-soluble film layer is a film selected for the group consisting of polyvinyl alcohol, polyoxyethylene, cellulose derivatives, sodium polyacrylate, polylactic acid, lactic acid ethers and esters of polyvinyl alcohol, lactic acid ethers and esters of cellulosics, carrageenan, pectin, combinations of the above, and combinations of the above with starches.

6. The packaging system of claim 1, wherein the agrichemical is selected from the group consisting of fertilizers and pesticides in a form selected from the group consisting of liquids, gels, dispersions, solutions, suspensions, emulsions, colloids, powders, granules, and prills.

7. The packaging system of claim 5 wherein said cellulose derivative of said outer layer is selected from the group consisting of methyl cellulose, methylhydroxyethyl cellulose, methylhydroxypropyl cellulose, hydroxypropyl cellulose, cellulose, cellulose monoacetate, and hydrophobically modified cellulose derivatives.

8. The packaging system of claim 6, wherein said pesticides are selected from the group consisting of herbicides, insecticides, and fungicides.

9. The packaging system of claim 1, wherein the agrichemical composition contains at least one component that dissolves, reacts deleteriously with, or otherwise adversely affects the outer cold water-soluble film layer.

10. The packaging system of claim 1, wherein the inner barrier layer has a thickness of between 0.25 microns and 25 microns.

11. The packaging system of claim 1, wherein the outer cold water-soluble film layer has a thickness of between 12 microns and 200 microns.

12. The packaging system of claim 1, wherein the inner barrier layer is a polymer layer which does not dissolve in water at temperatures below 50° C.

13. The packaging system of claim 1, wherein the inner barrier layer disintegrates in water.

14. The packaging system of claim 1, wherein the inner barrier layer is laminated to the outer cold water-soluble film layer.

15. The packaging system of claim 1, wherein the inner barrier layer is co-extruded with the outer cold water soluble film layer.

16. The packaging system of claim 1, wherein the inner barrier layer is coated onto the outer cold water-soluble film layer.

17. A method of packaging an agrichemical or agrichemical composition which chemically or physically reacts with a cold water-soluble film comprising:

forming a bag from a composite film said composite film comprising an outer layer of the cold water-soluble film and an inner barrier layer that does not react with or become dissolved by the agrichemical or agrichemical composition, the inner barrier layer being a continuous film and forming the bag interior and being dissolvable or dispersible into particles not in excess of 250 microns in cold water upon dissolution of the cold water-soluble layer, the inner barrier layer being a polymer layer which does not dissolve in water at temperatures above 50° C. and is selected from the group consisting of cellulose derivatives in which the degree of substitution is sufficient to prevent solubility above 50° C. selected from the group consisting of cellulose acetate lactate, cellulose lactate, methylhydroxybutyl cellulose, hydrophobically modified cellulose derivatives, and combinations thereof;

adding a desired amount of the agrichemical or agrichemical composition into the bag, said outer cold water-soluble film layer providing structure to said bag; and thereafter sealing the bag with agrichemical or agrichemical composition contained therein, the inner barrier layer preventing the agrichemical or agrichemical composition from contacting the outer cold water-soluble film layer.

18. The method of claim 17 wherein said inner barrier layer is cold water soluble.

19. The method of claim 17 wherein said inner barrier layer is cold water insoluble.

20. A water soluble bag adapted for containing an agrichemical or agrichemical composition therein, the agrichemical composition comprising at least said agrichemical therein, said agrichemical composition or agrichemical substantially deleteriously-affecting a cold water-soluble film, said bag comprising an outer layer of the cold water-soluble film and an inner barrier layer, said inner barrier layer being a continuous film and wherein said agrichemical and said agrichemical composition do not react with or substantially deleteriously affect the inner barrier layer and the inner layer is capable of preventing the agrichemical and agrichemical composition when stored in said bag from contacting the cold water-soluble film layer, the inner barrier layer being a polymer layer which does not dissolve in water at temperatures above 50° C. and is selected from the group consisting of cellulose derivatives in which the degree of substitution is sufficient to prevent solubility above 50° C. selected from the group consisting of cellulose acetate lactate, cellulose lactate, methylhydroxybutyl cellulose, hydrophobically modified cellulose derivatives, and combinations thereof, and wherein when the bag is placed in water with the agrichemical or agrichemical composition stored therein, said outer layer of cold water-soluble film dissolves and said inner barrier layer dissolves or disperses into particles of up to 250 microns, said particles being small enough to allow the agrichemical and agrichemical composition to disperse into the water, and said outer cold water-soluble film layer providing structure to said bag.

21. The bag of claim 20, wherein the cold water-soluble film layer is a film selected from the group consisting of polyvinyl alcohol, polyoxyethylene, and combinations thereof.

22. The bag of claim 21, wherein the inner barrier layer is a polymer which dissolves in water but is substantially less reactive than polyvinyl alcohol or polyoxyethylene to the agrichemical and agrichemical composition to be contained in said bag.

23. The bag of claim 22, wherein the inner barrier layer is selected from the group consisting of cellulose derivatives which have a degree of substitution (DS) or moles of substitution (MS) that provides solubility at a temperature of at least 5° C.

24. The bag of claim 20, wherein the cold water-soluble film layer is a film selected from the group consisting of polyvinyl alcohol, polyoxyethylene, cellulose derivatives selected from the group consisting of methyl cellulose, methylhydroxyethyl cellulose, methylhydroxypropyl cellulose, hydroxypropyl cellulose, cellulose, cellulose monoacetate, hydrophobically modified cellulose derivatives, sodium polyacrylate, polylactic acid, lactic acid ethers and esters of polyvinyl alcohol, lactic acid ethers and esters of cellulosics, cellulose esters, carrageenan, pectin, combinations of the above, and combinations of the above with starch.

25. The bag of claim 20, wherein the inner barrier layer has a thickness of between 0.25 microns and 15 microns.

26. The bag of claim 20, wherein the cold water-soluble film layer has a thickness of between 12 microns and 200 microns.

27. The bag of claim 20, wherein the inner layer is a polymer film which does not dissolve in water at temperatures above 5° C.

28. The bag of claim 27, wherein the inner barrier layer is a cellulose derivative in which the degree of substitution is sufficient to prevent solubility above 5° C. selected from the group consisting of cellulose acetate lactate, cellulose lactate, methylhydroxybutyl cellulose, and hydrophobically modified cellulose derivatives.

29. The bag of claim 20, wherein the inner barrier layer is a polymer film which does not dissolve in water at a temperature below 50° C.

30. The bag of claim 20, wherein the inner barrier layer disintegrates in water.

31. The bag of claim 20, wherein the inner layer is laminated to the outer cold water-soluble film layer.

32. The bag of claim 20, wherein the inner barrier layer is co-extruded with the outer cold water-soluble film layer.

33. The bag of claim 20, wherein the inner layer is coated onto the outer cold water-soluble film layer.

* * * * *